US005690786A

United States Patent [19]

Cirucci et al.

[11] Patent Number: 5,690,786

[45] Date of Patent: Nov. 25, 1997

[54] PROCESS FOR THE TREATMENT OF PULP WITH OXYGEN AND STEAM USING EJECTORS

[75] Inventors: John Frederick Cirucci; Jeffrey Alan Knopf, both of Allentown; Vincent Louis Magnotta, Wescosville; William Paul Schmidt, Allentown, all of Pa.

[73] Assignee: Air Products and Chemicals Inc., Allentown, Pa.

[21] Appl. No.: 797,866

[22] Filed: Nov. 26, 1991

[51] Int. Cl.[6] ..... D21C 9/147

[52] U.S. Cl. ..... 162/6; 162/57; 162/65; 162/68

[58] Field of Search ..... 162/65, 57, 40, 162/68, 63, 6

[56] References Cited

U.S. PATENT DOCUMENTS

| | | | |
|---|---|---|---|
| 3,024,158 | 3/1962 | Grangaard et al. | 162/17 |
| 3,951,733 | 4/1976 | Phillips | 162/65 |
| 4,220,498 | 9/1980 | Prough | 162/25 |
| 4,248,662 | 2/1981 | Wallick | 162/19 |
| 4,259,150 | 3/1981 | Prough | 162/40 |
| 4,515,655 | 5/1985 | Schaefer | 162/57 |
| 4,543,155 | 9/1985 | Stawicki | 162/57 |
| 4,642,690 | 2/1987 | Gazdik et al. | 162/57 |
| 4,674,888 | 6/1987 | Carlson | 162/65 |

FOREIGN PATENT DOCUMENTS

22021/88 6/1990 Australia .

OTHER PUBLICATIONS

Arakin, 1E and Evdokimov, An; "Oxygen–Soda Pulp Digestin Using the Ejector"; Bumah. Pom. No. 8, Aug. 1979, pp. 20–22.

Arakin, 1E and Evdokimov, An; "Apparatus Designed for Single–Stage Oxygen/Aikoli Pulp"; Bumazh. Prom. Nov. 3, 30 Mar. 1981.

Perkins, Joseph K.; "Implementation of Wood Pulp Chlorinatin Technology"; CPPA Tech. Sect. 66th Annual Meeting; 1980; 1980 pp. B95–98.

Haddock, H.; "Basics of Thermocompressors and Their Value to Paper Dujing"; BP1317 Tech. Dir. Working Grp; Dec. 6, 1978.

*Primary Examiner*—Steven Alvo

*Attorney, Agent, or Firm*—Geoffrey L. Chase

[57] ABSTRACT

A process for using ejectors to combine high pressure steam and low pressure oxygen to produce a steam and oxygen enriched gas single phase gas mixture for introduction into various pulp treatments using oxygen with the benefit of low cost compression, low capital requirements and superior oxygen mixing.

17 Claims, 2 Drawing Sheets

PROCESS FOR THE TREATMENT OF PULP WITH OXYGEN AND STEAM USING EJECTORS

FIELD OF THE INVENTION

The present invention is directed to the field of treatment of pulp using oxygen and steam. Move specifically, the present invention is directed to using relatively low pressure oxygen and relatively high pressure steam to form a single phase gas mixture at an intermediate but elevated pressure to be introduced into pulp with high levels of oxygen dispersion.

BACKGROUND OF THE PRIOR ART

The pulp and paper industry has sought methods for utilizing the beneficial reactive properties of oxygen in oxygen delignification, oxygen alkali extraction and ozone treatment of pulps. Oxygen has the beneficial value in pulp treatment of being relatively environmentally acceptable, while still providing significant levels of delignification, whitening for bleaching operations and more vigorous treatments with its use in the aggressive molecular form of ozone. The prior art has utilized oxygen in combination with pulping liquors and recycle streams of pulping liquors. For instance, in U.S. Pat. No. 3,024,158, a partially bleached pulp is contacted with a recycled liquor that has been oxygenated external to the pulp flow stream. The oxygen is already at a pressure of at least about 40 pounds per square inch and is entrained in the pulping liquor through a sophisticated absorption tower. The oxygen is administered to the pulp in a two phase stream of liquid liquor and gaseous oxygen.

A similar disclosure of oxygen enriching recycled pulping liquor is set forth in U.S. Pat. No. 4,248,662.

Multiple administrations of oxygen and steam separately into a pulping and bleaching apparatus is set forth in U.S. Pat. No. 3,951,733. This patent also discloses the introduction of oxygen into a pulp stream under conditions of high speed mixing.

U.S. Pat. No. 4,259,150 discloses a technique for bleaching pulp, wherein oxygen, sodium hydroxide and water are introduced into various stages of a pulp stream at the point of a mixing device.

U.S. Pat. No. 4,220,498 discloses a method for delignification of pulp mill rejects wherein caustic oxygen and steam are added by means 32 of FIG. 2 as set forth at column 4, line 22 of that patent.

U.S. Pat. No. 4,543,155 discloses the use of oxygen in bleaching wood pulp in an extraction stage wherein, in FIG. 2, dilution water in line 25, passing through venturi 40, disperses oxygen, in line 24, into the dilution water for administration through nozzles 26. In this instance, oxygen is either dissolved in the dilution water or passes in two phase flow into the pulp stream.

The article "Oxygen-Soda Pulp Digestion Using the Ejector" by I. E. Arakin and A. N. Evdokimov, appearing in Bumazh. Prom. No. 8, August 1979, pages 20 through 22, discloses a method for conducting oxygen-soda pulp digestion wherein the cooking liquid is aerated off an autoclave using an ejector.

In the literature article "Apparatus Designed for Single-Stage Oxygen/Alkali Pulp" by I. E. Arakin and A. N. Evdokimov, in Bumazh. Prom. No. 3, 30 Mar., 1981, tests were conducted for appropriate equipment for mixing oxygen and cooking liquor for oxygen-alkali pulping in a Kamyr digester. A gas-liquid jet reactor, a water-air ejector and a turbine mixer were all evaluated.

In an article "Implementation of Wood Pulp Chlorination Technology" by Joseph K. Perkins, CPPA Tach. Sect., 66th Annual Meeting 1980 p. B95–P98, the use of ejectors to administer chlorine bleaching agents was described. The article goes on to indicate that chlorine gas is not readily dissolved in water and therefore the mixture evolving from the recited ejectors contains bubbles representative of two phase flow.

The article "Basics of Thermocompressors and Their Value to Paper Drying" by H. Haddock, BPBIF Technical Division Working Group, Dec. 6, 1978, discloses the use of thermocompressors to use low pressure steam in drying pulp and to specifically use refiner steam in a recycle to the chip heating chamber of a thermo-mechanical pulping system in which the refiner steam is pressurized with high pressure steam in a thermocompressor.

Despite the wide use of oxygen in pulping processes, the industry still seeks an inexpensive, low capital method for adequately treating pulp with oxygen, particularly low cost sources of oxygen which generally are available at only low pressures insufficient for introduction into a pulp stream without some form of pressurization. Full dispersion of oxygen in a pulp stream has also been continually sought by the industry. These problems have been overcome by the present invention set forth below.

BRIEF SUMMARY OF THE INVENTION

The present invention is a process for the oxygen treatment of pulp at elevated temperature and pressure in which high pressure steam, as a motive fluid, is premixed with low pressure oxygen-enriched gas, as a suction fluid, in an ejector and the resulting steam and oxygen-enriched single phase gas mixture, at a pressure intermediate to the high and low pressures recited, is introduced into the pulp to provide a high dispersion of oxygen in the pulp and to effect enhanced oxygen treatment of the pulp.

Preferably, the high pressure steam is in the range of approximately 100 to 1600 psia.

Preferably, the low pressure oxygen-enriched gas is at least 85% oxygen. More preferably, the low pressure oxygen-enriched gas is at least 93% oxygen.

Preferably, the gas mixture is introduced into the pulp in a zone of high shear mixing of the pulp.

Alternatively, the gas mixture is introduced into the pulp in a zone of turbulent, fluidized condition of the pulp.

Alternatively, the steam and oxygen-enriched gas are premixed in a first ejector and a portion of the resulting mixture is introduced into a pulp at a first intermediate pressure and the remaining portion of the resulting mixture is mixed with additional high pressure steam in a second ejector to result in a second higher intermediate pressure steam and oxygen-enriched gas mixture which is introduced into a pulp at the second higher intermediate pressure. More preferably, the steam and oxygen-enriched gas mixture from the first ejector is cooled and a portion of the steam is condensed and removed from the mixture before the mixture is introduced into the second ejector.

Preferably, the oxygen treatment is an oxygen delignification. Preferably, the oxygen treatment is an oxygen alkali extraction.

Further alternatively, the oxygen treatment is an oxygen treatment of secondary fiber pulp.

Preferably, after the steam and oxygen-enriched gas mixture is introduced to the pulp, the oxygen from the mixture is held in contact with the pulp for a sufficient time to effect oxygen treatment of the pulp. More preferably, the time of the contact is in the range of approximately 3 to 120 minutes.

Preferably, the oxygen-enriched gas is at a pressure of approximately 10 to 55 psia prior to entering the ejector.

Preferably at least a portion of the oxygen-enriched gas is residual off-gas vented from an oxygen-pulp treatment zone.

Alternatively, at least a portion of the oxygen-enriched gas is residual off-gas vented from an ozone-pulp treatment zone.

DETAILED DESCRIPTION OF THE INVENTION

Figure 1:
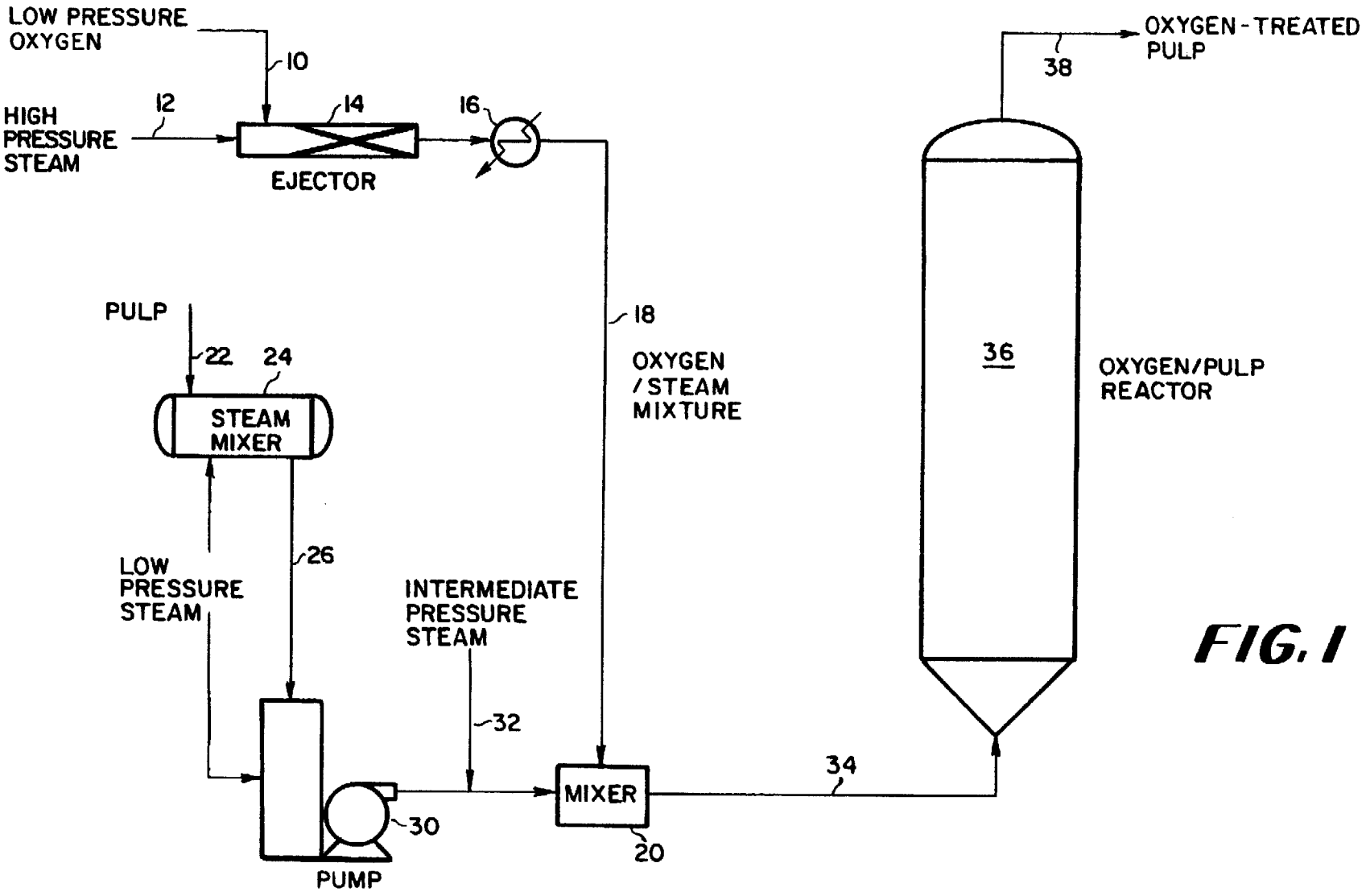
FIG. 1. is a schematic illustration of a preferred embodiment of the present invention showing oxygen being pressurized with high pressure steam in an ejector prior to administration into a pulp stream at a zone of mixing.

In the present invention, oxygen treatment includes oxygen delignification of unbleached pulps, oxygen alkali extraction, oxygen bleaching, of oxygen treatment of secondary fibers to effect increased brightness, color removal, reduced kappa number, and/or removal of shives and contaminants. Oxygen delignification is sometimes referred to in the art as oxygen bleaching and such usage is contemplated in the present use of oxygen delignification.

In pulp mill processes requiring the treatment of a pulp slurry of wood pulp or secondary fiber with gaseous oxygen, it is difficult to provide for adequate mass transfer of oxygen to and into the pulp fiber where it reacts. There are several reasons why oxygen/pulp processes are particularly problematic in processes, such as oxygen delignification. The oxygen requirement is usually much greater than the oxygen solubility limit in the liquid phase of the slurry. This means that most of the oxygen must be introduced and initially retained in the gas phase of the three phase system. In order to react, the gaseous oxygen must dissolve at the gas/liquid interface, diffuse through the bulk liquid phase, and diffuse into the pulp fiber. Mass transfer becomes severely limiting unless a large gas/liquid interfacial surface area is provided and the gas phase is intimately dispersed throughout the liquid phase to minimize the bulk phase diffusion distance. Mass transfer limitations lower the uptake rate of oxygen, thereby increasing the size requirement and cost of the reactor or reducing the extent of reaction if the retention time is limited. Attempts to compensate for these problems have resulted in excessive oxygen usage.

In order to maximize the level of dissolved oxygen in the liquid phase of a pulp slurry and, hence the rate of reaction with the pulp, oxygen/pulp processes are usually operated at moderately elevated pressures in the range of approximately 35–195 psia. If the oxygen is produced on-site, an oxygen compressor is required to deliver the oxygen at a pressure greater than the process pressure. There are additional capital and operating costs associated with this compressor.

The method of pulp handling for oxygen treatment is dependent upon the pulp consistency. High and medium consistency pulps are not fluid under most conditions. This poses many difficulties in mixing and conveyance. Conventional pumps and mixers cannot be used. Low consistency pulp is fluid, but cannot retain a gas phase in stable dispersion. The gas phase must somehow be continuously or periodically remixed into the slurry. Additionally, low consistency pulp has such a high water content that reactor vessel size, steam requirements and chemical requirements are very large.

For instance, high consistency pulp processes are known wherein the pulp is raised to consistency of greater than 16%, usually 20% to 30%, by using high consistency presses to remove most of the liquid from the pulp. At these consistencies, there is no bulk liquid phase, but only a liquid film on the fibers. The pulp is then fluffed and charged into the top of the reactor vessel. Steam is used directly to heat the pulp by application onto the pulp after the press and/or by injection to the top of the reactor. The reactor is kept pressurized with oxygen, which infiltrates through the fluffed pulp. The oxygen gas is readily adsorbed into the thin liquid film coating the pulp fibers.

Another example is directed to medium consistency pulp processes. Pulp is withdrawn from a pulp washer or decker at 8% to 16% consistency. It is pumped up to the required process pressure using a specialized pump designed for handling medium consistency pulp. After the pump, oxygen can be intimately mixed with the pulp to create a very fine gaseous dispersion in the pulp slurry. Because of the dense fiber network in medium consistency pulp, this dispersion is stable under moderate pressure. The dispersion can be produced using a specialized mechanical mixer, or in some instances, injected directly into the pulp using inline spargers at the pump discharge. The latter method is applicable to systems utilizing centrifugal pumps, which discharge pulp in a turbulent fluidized state. Steam is usually applied to the pulp in a steam mixer upstream of the pump or directly into the pump suction tube. Alternatively or supplementally, steam can be added to the pressurized pulp in a zone of high shear mixing. Upon application to the pulp, the steam rapidly condenses. The heated pulp maintaining a well dispersed oxygen phase is then charged into a reactor.

Low consistency pulp processes exist wherein the low consistency pulp is fluid and can be pumped using standard equipment. Gases can easily be mixed using an inline, static mixer. Despite the much larger water quantity in low consistency slurries, oxygen's low solubility prevents complete dissolution of the desired oxygen dosage. Because low consistency pulp lacks the dense fiber network required to maintain a stable gas dispersion under static conditions, the dispersed gas phase will quickly separate unless the oxygen is continuously or periodically remixed into the slurry. This combined with the need for very large reactors and high steam and caustic requirements makes low consistency treatment the least desirable.

The present invention, by using low cost, low pressure oxygen and available high pressure steam that is mixed in an ejector, wherein the high pressure steam acts as the motive fluid to enhance the pressure level of oxygen, while the oxygen constitutes the suction fluid to be pressurized, creates an elevated pressure, single phase, gas mixture at an appropriate pressure intermediate to the low pressure oxygen and the high pressure steam which can then be introduced into a pressurized pulp stream as a single gas phase to impart the heat of the high pressure steam to the pulp, while at the same time providing an unusually high level of dispersion of a gas phase oxygen in the pulp medium. Upon contact of the single phase gas mixture of steam and oxygen on the pulp, the steam condenses rapidly, leaving the oxygen in a well dispersed form intimately mixed with the pulp medium such that the gas/liquid interfacial area is higher than that achieved with prior art techniques. This enhances the rate of reaction while using the lowest cost oxygen, such as would be available at lower purities and lower pressures.

Lower pressure, lower purity oxygen such as oxygen of 85% oxygen purity levels or higher and low pressures in the range of approximately 10 to 55 psia, are readily available from low cost sources, such as on-site vacuum swing adsorption systems, pressure swing adsorption systems, or small cryogenic air separation plants. These systems typically provide inexpensive oxygen sourcing, but at purities and pressures lower than typically provided by cryogenically sourced oxygen, which is transported to pulp mill sites in the liquid form for revaporization prior to administration to pulp.

Most pulp mills have available high pressure steam (100 to 1600 psia) within the mill site, which if not dedicated to actual process use, is utilized to generate power. According to the present invention this high pressure steam can be utilized in part to provide an attractive compression source for low pressure low cost oxygen. The use of high pressure steam as the motive fluid in ejectors also has the added benefit of providing an intimate mixture of oxygen and steam without sophisticated mixing equipment, along with the ability when introduced into the pulp to impart heat for enhanced oxygen treatment upon condensation of the steam to water. By administering the high pressure steam as the motive fluid in an ejector to pressurize oxygen as the suction fluid, an inexpensive, superior source of compressed oxygen is provided to a pulp stage with superior intimate mixing and dispersion of the oxygen by way of the steam carrier gas which readily condenses out of the gas phase upon contact of the pulp with the steam/oxygen mixture.

Although the present invention is beneficial for the administration of low cost, low pressure oxygen from sources such as adsorption separation, this steam-powered ejector process for administering oxygen for oxygen treatment of pulp is also attractive for recycle oxygen sources, such as off gases vented from oxygen delignification, or ozone pulp treatment zones. These vented off gases provide reasonable levels of oxygen at low pressures and are desirable if they can be economically recycled. The process of the present invention using a high pressure steam powered ejector to pressurize low pressure oxygen is a unique match for such oxygen enriched gas streams being recycled from oxygen pulp processing to oxygen pulp contact zones where higher pressures of oxygen and adequate dispersions are dictated.

Although the mixing of high pressure steam and low pressure oxygen in an ejector provides an intimate mixture of a single phase gas mixture, it is also desirable in the preferred embodiment of the present invention to administer the steam and oxygen enriched gas mixture into a pulp in a zone of high shear mixing or in a zone where the pulp slurry is in a turbulent fluidized condition. The process of the present invention is effective in oxygen treatment of pulp slurries in consistency ranges including low consistency pulps in the consistency range of approximately 0.5 to 8% and medium consistency pulp in the range of approximately 8% to 16% consistency.

Although it is envisioned that the mass ratio of high pressure steam to low pressure oxygen required for compression in an ejector would be in the range of approximately 3 to 20, it is further contemplated that additional steam may be necessary for adequate oxygen treatment of pulp and such steam can be added independently either upstream or downstream of the application point of the steam and oxygen enriched gas single phase gas mixture. A higher steam to oxygen mass ratio in the ejector, such as up to 50, may not be required for compression, but may be desirable for enhanced dispersion of oxygen in pulp.

Various wood pulps or secondary fiber pulps can be treated with the steam-oxygen enriched gas process of the present invention and preferably in an aqueous slurry at a consistency capable of maintaining stable dispersed gas phase oxygen, preferably a medium consistency of approximately 8% to 16%. The oxygen dosage requirements for pulp ranges from approximately 0.3 to 1.5 weight % oxygen on oven-dried pulp for oxygen alkali extraction and approximately 1–3 weight % oxygen on oven-dried pulp for oxygen delignification of unbleached pulp.

The steam flow rate to the ejector should be less than or equal to the amount required to heat the pulp to required process temperature, which is typically 50 to 170 wt % steam on oven-dried pulp for medium consistency oxygen processes. The flow may be further limited by the gas volume capacity of the pulp mixing device, particularly where devices are in place and have been designed for oxygen flow only. For successful ejector operation, the minimum requirement of steam is determined by the oxygen flow rate, the oxygen feed pressure, and the pulp process pressure. The minimum steam requirement will usually be greater than or equal to three times the mass flow rate of oxygen for most practical operating conditions.

The ejectors contemplated in the present invention are sometimes referred to as evactors, eductors, jet compressors or thermocompressors. As set forth above, the ejectors may be used in combination in a series connection to arrive at further elevated pressure conditions. In addition, the ejectors may be used in parallel to maintain efficiency during turndown conditions. The primary benefits of using steam ejectors are the elimination of the capital required for the oxygen compressor and to a lesser extent, the elimination of the power required by the compressor. As set forth above, there are additional benefits, such as improved oxygen/pulp mixing. The most significant cost associated with operation of an ejector system is the cost of high pressure steam. Heat recovery from the steam used as the motive fluid is inherent in the ejector system since the applications of the present invention are for processes which require steam for direct heating. However, steam heating is normally accomplished using steam at a lower pressure than that required by the ejector. Therefore the cost of high pressure steam is based on the lost potential to do work or produce electric power with it.

An ejector is a simple device designed to create a vacuum or compress a fluid using another pressurized fluid. The fluid to be compressed, in this case oxygen, is the suction fluid and the pressurizing fluid, in this case steam, is known as the motive fluid. A typical ejector consists of a nozzle, mixing chamber and diffuser. The motive steam is expanded to the suction pressure through a converging-diverging nozzle from which it exits at high, usually sonic, velocity. The suction fluid is entrained by the high velocity motive fluid and they mix as they traverse the converging inlet cone of the diffuser. Recompression results from the sonic shock wave formed in the diffuser's throat and the velocity reduction in the outward-tapered diffuser discharge. Ejector performance is highly dependent on geometry and may vary between ejector types. The ejectors are single point design devices and are configured for a specific suction, motive and discharge conditions. Turndown in excess of 15% can be best accomplished by employing several ejectors in parallel and shutting them off as required. Under some circumstances, particularly when a high discharge pressure is required, it is beneficial to use several ejectors in series.

It may be desirable to include an interstage condenser in an ejector system for the present invention. An interstage condenser located between ejectors in series may potentially reduce the total steam requirement. Because of the impact of steam on operating cost, any reduction will quickly compensate for the additional equipment cost of the condenser. The heat and condensate recovered from the condenser can be returned to the boiler for steam generation or used for heat and water addition to a process in the pulp mill.

It may be desirable to incorporate a desuperheater after the ejector system to cool the steam/oxygen mixture down to or just above the condensation point. This will minimize the volume of gas which must be applied to the pulp and will minimize the undesirable changes of pulp characteristics due to contact with a very high temperature gas. The energy penalty of the desuperheating is small. Two typical pulp mill applications which require both oxygen and steam are oxygen delignification of unbleached pulp and oxygen alkali extraction. Since oxygen delignification is currently of greater commercial interest and has potential for onsite oxygen supply, it is set forth for evaluation. Typical oxygen delignification conditions are as follows:

| | |
|---|---|
| Pulp Rate (ODTPD) | 300 to 1400 oven-dry tons per day |
| Pulp Consistency | 9 to 13 wt % in water |
| Process Pressure | 90 to 180 psig at oxygen mixer |
| Process Temperature | 200 to 215° F. |
| Pulp Temperature before steam addition | 80 to 130° F. |
| Oxygen Dosage | 1.5 to 2.5 wt % on oven-dry pulp |

Typically in the prior art, the pulp is heated to process temperature by direct addition of steam, usually prior to oxygen addition. Pulp mills have low pressure steam (50–70 psig) readily available and sometimes in excess. It is therefore desirable to heat the pulp before it is pumped up to process pressure with low pressure steam added in a peg-type steam mixer or in the suction tube of a medium consistency pump. It is difficult to heat the pulp to much greater than 180° F. with low pressure steam because steam flash losses become excessive. Intermediate pressure steam (150–180 psig) is usually added to the pressurized pulp at the pump discharge or oxygen mixer to provide supplemental heating.

The steam ejector system of the present invention requires a motive steam pressure greater than that used for pulp heating. Steam conditions will be site specific. A kraft mill will generate steam in its recovery boiler and often in a power boiler at pressures as high as 1200 to 1600 psia. The steam pressure level used in the ejector system will depend on steam availability. Typically, steam suitable for use in the ejector will be available in the range of 450 to 800 psia (superheated). For this embodiment, representative motive steam conditions of 615 psia, 650° F. were chosen.

The steam/oxygen mixture can be applied to the pulp using a high shear mixing device or injection into the turbulent discharge zone of some types of medium consistency pumps. The steam will rapidly condense to provide direct heating of the pulp. The amount of steam required in the ejector will usually be less than the total amount required by the oxygen delignification stage. In most cases, this high pressure ejector steam will only partially replace the intermediate pressure steam requirement. Thus, the maximum amount of inexpensive low pressure steam can be maintained. The ejector system steam penalty then becomes the value of the high pressure steam used, less the value of the intermediate pressure steam eliminated.

An important aspect of applying steam and oxygen onto the pulp as a mixture is improved mixing of oxygen with the pulp. This can increase the degree or rate of reaction, and can also permit unconventional methods of oxygen introduction (e.g. peg mixers, inline injection into plug flow, etc.).

Estimated net savings using a steam ejector system of the present invention as an alternative to an oxygen compressor for typical conditions expected at a pulp mill are set forth in Table 1.

TABLE 1

STEAM AND POWER BALANCE SUMMARY FOR AN OXYGEN DELIGNIFICATION STAGE WITH EJECTOR COMPRESSION

BASIS: 800 ODTPD OXYGEN DELIGNIFICATION STAGE NET CHANGE FROM BASE CASE WITH OXYGEN COMPRESSOR

| | EJECTOR | |
|---|---|---|
| EJECTOR PROCESS CONDITIONS | COMPRESSION TO 100 PSIG | COMPRESSION TO 150 PSIG |
| OD Stage Steam Requirements (lb/hr) | | |
| 615 psia steam | 6810 | 18135 |
| 175 psia steam | −7420 | −19758 |
| 75 psia steam | No change | No change |
| Mill Power (kw) | | |
| $O_2$ Compressor Credit | −45 | −58 |
| Turbine Power Production Loss | 175 | 464 |
| Net Requirement | 130 | 406 |

The present invention will now be set forth in greater detail with reference to FIG. 1 and a preferred embodiment of the present invention. With reference to FIG. 1 a system in accordance with the present invention is illustrated wherein oxygen in line 10 typically from a low pressure source having an inline pressure between 10 and 55 psia and generally produced from an on-site plant, such as a vacuum swing adsorption air separation system, is provided as the suction fluid into an ejector 14 that is charged with high pressure steam motive fluid from line 12. This steam is at a pressure of between 100 and 1600 psia. The oxygen in line 10 is elevated in pressure and intermixed with the steam to result in a steam and oxygen enriched gas mixture of a single phase composition in line 18 at an intermediate pressure of between 40 and 200 psia. This stream has been initially desuperheated in desuperheater 16 directly or indirectly with cooling water. Simultaneously, pulp in line 22 is mixed with steam in a traditional steam mixer 24 being supplied with low pressure steam at a pressure of approximately 75 psia. The partially heated pulp is transferred in line 26 to a thick stock pump or medium consistency pump 30. Low pressure steam at approximately 75 psia may be injected into the pulp at the suction to pump 30 in addition to, or as an alternative to, injection at mixer 24. Intermediate pressure steam in line 32 at approximately 175 psia is introduced into the pulp to further elevate its temperature. The steam and oxygen enriched gas single phase gas mixture in line 18 is introduced into the pulp in a high shear mixing device 20. Such mixers are well known in the industry and include IMPCO's High Shear® mixer and Kamyr's MC® mixer. Mixing device 20 may also represent a turbulent, fluidized zone at the outlet of pump 30 where the steam and oxygen enriched gas single phase gas mixture is applied directly or with spargers into the pulp slurry. The steam provides heat to the pulp and immediately condenses leaving the oxygen extremely well mixed in the pulp in line 34.

A residence time is required for the reaction between pulp and the oxygen in its finely dispersed condition within the pulp, and vessel 36 constituting an oxygen/pulp reactor is designed to provide a residence time of approximately 3 to 120 minutes for appropriate timing of the oxygen and pulp contact. After a significant extent of oxygen delignification, the pulp is then removed in line 38.

The result is to provide oxygen treatment of pulp from a low pressure oxygen source using an inexpensive and mechanically simple ejector in place of an expensive, mechanical oxygen compressor to provide an intimate mixture of high pressure steam and low pressure oxygen at an elevated but intermediate pressure of between 40 and 200 psia. This intimate mixture is then introduced into the pulp wherein the steam rapidly condenses, heating the pulp and leaving the oxygen in a well dispersed nature in the pulp.

Figure 2B:
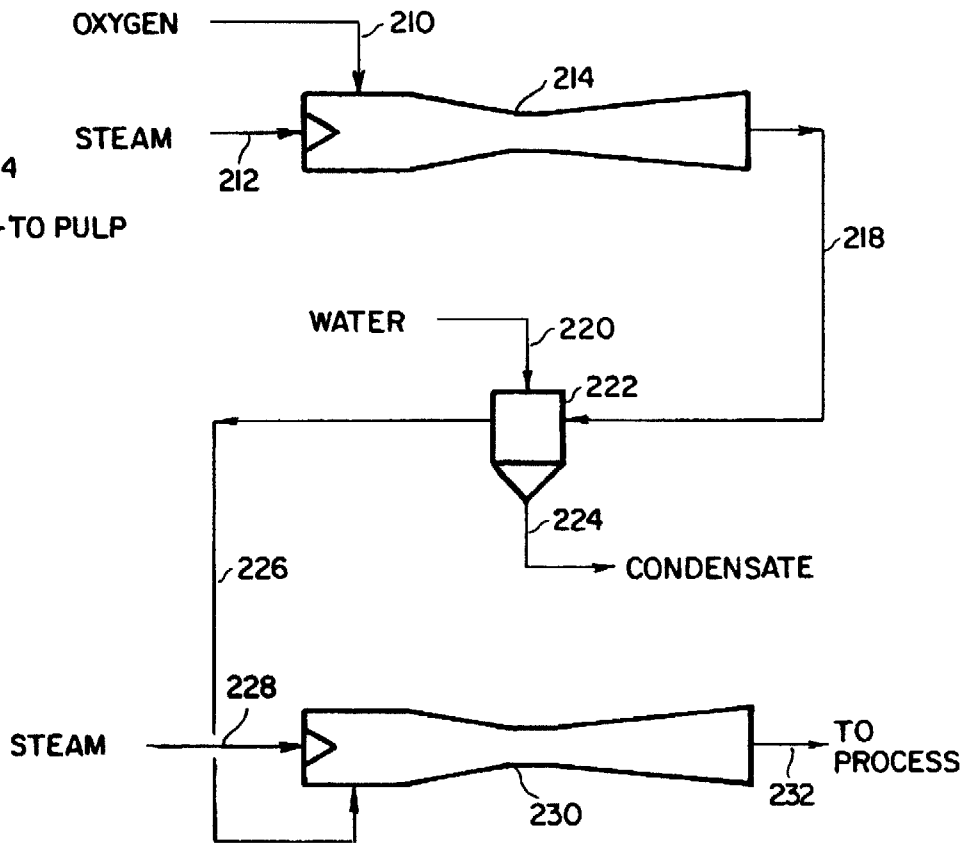
FIG. 2B is a schematic illustration of a preferred embodiment of the present invention using two ejectors in series to elevate an oxygen gas to higher intermediate pressure in stages with interstage condensation.
Figure 2A:
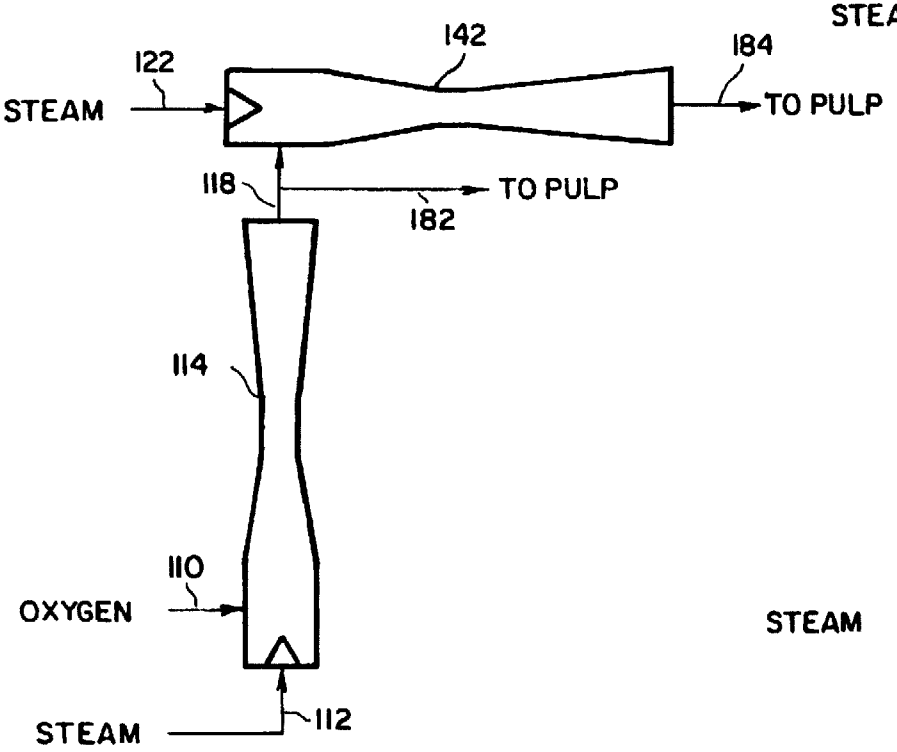
FIG. 2A is a schematic illustration of an embodiment of the present invention using two ejectors in series with the separate removal of a portion of the intermediate pressure gas mixture for use at pulp at lower intermediate pressure conditions.

Variations on this embodiment are set forth in the drawings in FIG. 2. With reference to FIG. 2A a series of steam ejectors are illustrated which accomplish potentially two goals. First, a series set of ejectors allows oxygen and the steam/oxygen-enriched gas, single phase, gas mixture to be elevated in pressure above what otherwise would be available in a single-stage ejector system. In addition, series placement of multiple ejectors allows removal of a first intermediate pressure level (approximately 40 to 100 psia) of such gas mixtures for different processing stages of the pulp process, such as oxygen alkali extraction.

For example, low pressure oxygen in line 110, as a suction fluid, can be elevated in pressure and intimately mixed with high pressure steam in line 112 being introduced as a motive fluid into an ejector 114. The resulting gas mixture in a single phase removed in line 118 can be introduced into a second ejector 142 in series which again is powered by high pressure steam in line 122. However, prior to this introduction, a gas mixture may be removed in part from line 118 in line 182 to provide an intermediate pressure (40 to 100 psia) steam/oxygen-enriched gas, single phase, gas mixture to be introduced into pulp at an appropriate intermediate pressure. The further elevated pressure steam/oxygen-enriched gas, single phase, gas mixture emanating from ejector 142 in line 184 can then be administered to pulp at a higher intermediate (100 to 200 psia) elevated pressure than otherwise could be achieved with a single stage ejector.

Alternatively, as illustrated in FIG. 2B, a series of ejectors may be utilized to further pressurize in its entirety an oxygen enriched gas in line 210 of low pressure, such as 5 psia. In this instance high pressure stream in line 212 is used as motive fluid to elevate the pressure of the suction fluid oxygen in line 210 in a first ejector 214. The resulting steam and oxygen enriched gas single phase, gas mixture in 218 is at an intermediate pressure such as 60 psia is cooled by cooling water 220 in heat exchanger 222 with removal of condensate with the water in line 224. The cooled and denser (steam lean) steam and oxygen enriched gas, single phase, gas mixture in line 226 is then subjected to a second series pressure elevation with high pressure steam in line 228 by means of an ejector 230. The resulting further elevated steam/oxygen-enriched gas, single phase, gas mixture is removed in line 232 at a pressure such as 150 psia to be used in processing pulp and oxygen delignification. The benefit of this intermediate cooling and condensation of water from the steam/oxygen-enriched, gas mixture is to minimize the overall steam requirement of the present invention. Specific process improvements due to mass transfer enhancement will vary dependent on the actual equipment and pulp at each pulp mill, however, the potential for improved mass transfer can be quantified theoretically. This process will increase the rate and uniformity of oxygen uptake in the pulp slurry by increasing the interfacial surface area between the gas and liquid/solid phases. For systems which are severely mass transfer limited and which utilize pulp mixing devices designed to produce uniform-sized, dispersed gas bubbles throughout the slurry, the rate of oxygen uptake can be increased by a factor of:

$$\phi = \frac{R_{O2,enhanced}}{R_{O2,conventional}} = \left(\frac{Q_{O/S}}{Q_O}\right)^{1/3}$$

where;

$\phi$=oxygen uptake rate improvement factor, $R_{O2,enhanced}$=oxygen uptake rate using improved techniques taught by present invention, $R_{O2,conventional}$=oxygen uptake rate using prior art techniques, $Q_{O/S}$=volumetric flow of the oxygen/steam mixture, and $Q_o$=oxygen volumetric flow.

For example, if a 10% consistency pulp slurry is to be dosed with 1 wt % oxygen and heated by steam from 70° F. to 185° F., adoption of this process can increase the rate of oxygen uptake to as much as 5.5 times the rate observed with conventional techniques.

There are important advantages gained by improving oxygen mass transfer and increasing the oxygen uptake rate in an OD or Eo stage:

Smaller reactor vessel volumes are required for a given extent of reaction.

The extent of reaction can be increased for a given retention time.

Less oxygen will be required due to reduction in excess oxygen wastage.

There is an improved potential to use less power-intensive, costly, and complicated pulp mixing devices.

The temperature and/or pressure required to achieve a given extent of reaction may be lessened.

Premixing oxygen with steam improves oxygen mass transfer by improving the characteristics of the oxygen gas phase dispersion in the pulp slurry. When oxygen mass transfer rate is the rate limiting step, the oxygen uptake rate is proportional to the total interfacial area between the gas and liquid phases:

$$R=k_L A(C_1-C_b)$$

where;

R=mass flow rate of $O_2$ into the bulk liquid phase, $k_L$=liquid mass transfer coefficient, A=total gas/liquid interfacial area, $C_1$=liquid phase $O_2$ concentration at the gas interface, and $C_b$=bulk liquid phase $O_2$ concentration.

For a fixed volume of gas the interfacial area increases with decreasing bubble size (a greater quantity of smaller bubbles). This area is inversely proportional to the bubble diameter:

$$A = n \pi d^2$$

$$V = n \frac{\pi}{6} d^3$$

where;

A=total gas/liquid interfacial area,

V=total volume of gas, n=number of bubbles, d=bubble diameter, then $$A = 6 \frac{V}{d}$$

By premixing steam and oxygen together, the total volume of gas initially mixed with the pulp is much greater than the volume of oxygen alone. The mixing device will produce a greater number of bubbles in dispersion. The steam will rapidly condense. The result is a greater number of smaller bubbles than would be achieved by mixing pure oxygen with the pulp. If the mixing device produces a constant bubble diameter independent of volumetric flow, the number of bubbles will increase according to the ratio of the volumetric gas flows:

$$\frac{n''}{n'} = \frac{Q_{ors}}{Q_o}$$

where;

n'=number of bubbles produced per unit time when pure oxygen only is added, and n"=number of bubbles produced per unit time when steam is premixed with oxygen.

The bubble diameter is proportional to the inverse cube root of the number of bubbles:

$$d = \left(\frac{6}{\pi} V_o\right)^{1/3} n^{-1/3}$$

where;

$V_o$=volume of oxygen-enriched (saturated) gas dispersed in the pulp just after the gas phase has reached thermal equilibrium with the pulp slurry, i.e., most of the steam has condensed.

$V_o$ is equivalent for the prior art technique and present invention, so the decrease in bubble diameter becomes:

$$\frac{d'}{d''} = \left(\frac{n''}{n'}\right)^{1/3} = \left(\frac{Q_{ors}}{Q_o}\right)^{1/3}$$

where;

d'=diameter of bubbles produced when pure oxygen only is added, and d"=diameter of bubbles produced when steam is premixed with oxygen, just after the gas phase has reached thermal equilibrium with the pulp slurry.

Since interfacial surface area is inversely proportional to bubble diameter, the increase in interfacial surface becomes:

$$\frac{A''}{A'} = \frac{d'}{d''} = \left(\frac{Q_{ors}}{Q_o}\right)^{1/3}$$

where;

A'=total interfacial area when pure oxygen only is added, and

A"=total interfacial area when steam is premixed with oxygen, just after the gas phase has reached thermal equilibrium with the pulp slurry, When oxygen mass transfer is rate limiting, the oxygen uptake rate increases accordingly:

$$\phi = \frac{R_{O2,\,enhanced}}{R_{O2,\,conventional}} = \left(\frac{Q_{ors}}{Q_o}\right)^{1/3}$$

When oxygen and steam are mixed, the volume of the mixture is greater than the sum of their individual volumes. This is because oxygen has a lower heat capacity than steam and the resulting temperature of the mixture is greater than the weight-averaged temperature of the individual gases. The result of this phenomena is a larger mixture volume and a further enhancement of the dispersion characteristics.

To demonstrate the expected improvements of this invention for typical pulp mill conditions, examples are provided:

EXAMPLE 1

Medium Consistency Oxygen Delignification System

Basis: 1000 oven-dry tons per day pulp

Conditions:

| | |
|---|---|
| slurry consistency | = 11% |
| pressure at pulp mixer | = 135 psia |
| temperature required after steam addition | = 210° F. |
| retention time requirements (using prior art techniques) | = 60 min |
| $O_2$ dosage | 2 wt % on pulp (1667 lbs/hr) |
| initial $O_2$ conditions (onsite plant without supplemental compression) | = 20 psia, 70° F. |
| total steam requirements for pulp heating | = 70,000 lbs/hr (slightly more if low pressure steam is used) |
| initial steam conditions | = 615 psia; 650° F. |

Using prior art techniques, the oxygen must be compressed to >135 psia using an oxygen compressor. In addition to adding to the total capital cost, the compressor would use approximately 50 KW of power.

Alternatively, using the techniques taught in the present invention, steam and oxygen can be combined in an ejector and desuperheated such that the ensuing mixture has the following characteristics at the point of mixing with the pulp slurry:

mixing pressure=135 psia mixed temperature=400° F.

The oxygen uptake rate improvement may be determined as shown above:

Volumetric oxygen flow rate without premixing;

$$Q_o = 2193 \frac{ft^3}{hr}$$

Volumetric oxygen flow rate at mixture conditions;

$$Q_o' = 3560 \frac{ft^3}{hr}$$

Volumetric steam flow rate at mixture conditions;

$$Q_s' = 251900 \frac{ft^3}{hr}$$

Mixture volumetric flow rate assuming Amagat's Law;

$$Q_{o2/s} = \Sigma V_i = Q_o' + Q_s' = 255500 \frac{ft^3}{hr}$$

The improvement in oxygen uptake rate is then;

$$\phi = \left(\frac{Q_{o/s}}{Q}\right)^{1/3} = \left(\frac{255500}{2193}\right)^{1/3} = 4.9$$

If oxygen mass transfer rate completely controls the rate of reaction, then the retention time requirements might be expected to be reduced to:

$$\frac{60 \text{ min}}{\phi} = 12 \text{ min}$$

It can be expected that this improvement would be most significant to the initial phase of the reaction when mass transfer limitations particularly dominate. Any reduction in retention time will reduce reactor volume requirements, significantly reducing MCOD capital costs. It also can permit delignification to be carried out to a greater extent, reducing downstream chemical requirements. The improved dispersion uniformity will possibly also improve the pulp characteristics (e.g. increased viscosity). As indicated, there is also a capital savings associated with the elimination of the oxygen compressor.

EXAMPLE 2

Oxygen Alkali Extraction (Eo) System

Basis: 600 oven-dry tons per day (ODTPD) pulp
Conditions:

| | |
|---|---|
| slurry consistency | = 10% |
| pressure at pulp mixer | = 75 psia |
| temperature after steam addition | = 165° F. |
| retention time requirements (using prior art techniques) | = 7 min |
| $O_2$ dosage | = 0.5 wt % on pulp (250 lbs/hr) |
| initial $O_2$ conditions (from storage) | = 55 psia, 70° F. |
| steam requirements for heating pulp | = 25,000 lbs/hr |
| initial steam conditions | = 175 psia; 410° F. |

Oxygen and 10% of the total steam requirement (2,500 lbs/hr) are thoroughly mixed in an ejector. The mixture has the following characteristics at the point of mixing with the pulp slurry:

mixing pressure=75 psia mixed temperature=370° F.

The oxygen uptake rate improvement factor may be determined as shown above:

Volumetric oxygen flow rate without premixing;

$$Q = 807 \frac{ft^3}{hr}$$

Volumetric oxygen flow rate at mixture conditions;

$$Q_o' = 927 \frac{ft^3}{hr}$$

Volumetric steam flow rate at mixture conditions:

$$Q_s' = 15950 \frac{ft^3}{hr}$$

Mixture volumetric flow rate assuming Amagat's Law;

$$Q_{o/s} = \Sigma V_i = Q_o' + Q_s' = 16877 \frac{ft^3}{hr}$$

The improvement in oxygen uptake rate is then:

$$\phi = \left(\frac{Q_{o/s}}{Q_o}\right)^{1/3} = \left(\frac{16877}{807}\right)^{1/3} = 2.8$$

This would likewise reduce the retention time requirement, permitting the use of a smaller diameter Eo upflow tube, or, perhaps, eliminating the need for backpressurization of the tube. Both improvements would result in reduced capital costs. For existing systems, this would be an effective and inexpensive method for increasing capacity without costly modifications to the Eo reactor.

Steam makes an ideal "carrier gas" for oxygen because it must be applied on the pulp anyway, and conveniently condenses shortly after pulp contact leaving a finer dispersion of oxygen. As shown above, this finer dispersion will reduce process retention time requirements (smaller reactors, greater extent of reaction with a fixed reactor volume) and/or permit the use of less efficient mixing methods (e.g. direct sparging into a plug flow slurry) without sacrificing process results. The unique result of the present invention for premixing oxygen and steam is in the use of an ejector system. The ejector is an excellent gas mixer and can eliminate the need for an oxygen compressor when oxygen is produced onsite. Ejectors are particularly well suited for this application because:

Both oxygen and steam are required in the oxygen treatment of pulp.

Oxygen is required under pressure.

There is an unexpected advantage to intimately mixing oxygen and steam before addition to the pulp.

The present invention has been set forth with reference to several preferred embodiments. However, the full scope of the present invention should be ascertained from the claims set forth below.

We claim:

1. A process for the elevated pressure oxygen treatment of pulp at elevated temperature and pressure in which high pressure steam, as a motive fluid, is premixed with low pressure oxygen enriched gas, as a suction fluid, in an ejector to elevate the pressure of said oxygen enriched gas and the resulting steam and oxygen enriched single phase gas mixture, at an elevated pressure intermediate to said high and low pressure, is introduced into the pulp to provide a high dispersion of intermediate pressurized oxygen in the pulp and to effect an enhanced oxygen treatment of the pulp.

2. The process of claim 1 wherein the high pressure steam is in the range of approximately 100 to 1600 psia.

3. The process of claim 1 wherein the low pressure oxygen enriched gas is at least 85% oxygen.

4. The process of claim 1 wherein the low pressure oxygen enriched gas is at least 93% oxygen.

5. The process of claim 1 wherein the mixture is introduced into the pulp in a zone of high shear mixing of the pulp.

6. The process of claim 1 wherein the mixture is introduced into the pulp in a zone of turbulent, fluidized condition of the pulp.

7. The process of claim 1 wherein the steam and oxygen enriched gas are premixed in a first ejector and a portion of the resulting mixture is introduced into a pulp at a first intermediate pressure and a remaining portion of the resulting mixture is mixed with additional high pressure steam in a second ejector to result in a second higher intermediate pressure steam and oxygen enriched gas mixture which is introduced into a pulp at said second higher intermediate pressure.

8. The process of claim 7 wherein the steam and oxygen enriched gas mixture from the first ejector is cooled and a portion of the steam is condensed and removed from the mixture before the mixture is introduced into the second ejector.

9. The process of claim 1 wherein the oxygen treatment is an oxygen delignification.

10. The process of claim 1 wherein the oxygen treatment is an oxygen alkali extraction.

11. The process of claim 1 wherein the oxygen treatment is an oxygen treatment of secondary fiber pulp.

12. The process of claim 1 wherein after the steam and oxygen enriched gas mixture is introduced to the pulp, the oxygen from the mixture is held in contact with the pulp for sufficient time to effect oxygen treatment of the pulp.

13. The process of claim 12 wherein the time of the contact is in the range of approximately 3 to 120 minutes.

14. The process of claim 1 wherein the oxygen enriched gas is at a pressure of approximately 10 to 55 psia prior to entering the ejector.

15. The process of claim 1 wherein at least a portion of the oxygen enriched gas is residual off-gas vented from an oxygen-pulp treatment zone.

16. The process of claim 1 wherein at least a portion of the oxygen enriched gas is residual off-gas vented from an ozone-pulp treatment zone.

17. A process for the elevated pressure oxygen treatment of pulp at elevated temperature and pressure in which high pressure steam, as a motive fluid, is premixed with low pressure oxygen enriched gas, as a suction fluid, in a first ejector to elevate the pressure of said oxygen enriched gas and a portion of the resulting steam and oxygen enriched single phase gas mixture, at a first intermediate elevated pressure to said high and low pressure, is introduced into the pulp to provide a high dispersion of oxygen in the pulp and to effect an enhanced oxygen treatment of the pulp and a second portion of said resulting mixture is cooled and a portion of the steam is condensed from said second portion and said second portion is mixed with additional high pressure steam in a second ejector to result in a second higher intermediate elevated pressure steam and oxygen enriched gas mixture which is introduced into a pulp at said second higher intermediate pressure to provide a high dispersion of elevated pressure oxygen in the pulp and to effect an enhanced oxygen treatment of the pulp.

* * * * *